US005887577A

United States Patent [19]

Sherrill

[11] Patent Number: 5,887,577

[45] Date of Patent: Mar. 30, 1999

[54] APPARATUS FOR PROPELLING A PROJECTILE

[76] Inventor: William T. Sherrill, 3101 Cedar Park Rd., Greensboro, N.C. 27405-9657

[21] Appl. No.: 964,342

[22] Filed: Nov. 4, 1997

[51] Int. Cl.[6] ..... F41B 3/02

[52] U.S. Cl. ..... 124/20.1

[58] Field of Search ..... 124/17, 20.1, 20.3; 403/325

[56] References Cited

U.S. PATENT DOCUMENTS

| | | | |
|---|---|---|---|
| 1,955,969 | 4/1934 | Marzolf | 403/325 X |
| 2,823,483 | 2/1958 | Malott . | |
| 3,683,882 | 8/1972 | Braxton . | |
| 3,802,409 | 4/1974 | Mike et al. | 124/20.1 |
| 4,133,333 | 1/1979 | Janssen | 124/20.1 |
| 4,373,503 | 2/1983 | Saunders | 124/20.1 |
| 4,805,583 | 2/1989 | Mosser | 124/20.1 |
| 4,852,543 | 8/1989 | Mosser | 124/20.1 |
| 4,922,884 | 5/1990 | Ford | 124/20.1 |
| 5,230,323 | 7/1993 | Saunders et al. | 124/20.1 |
| 5,398,665 | 3/1995 | Carlson | 124/17 |
| 5,493,807 | 2/1996 | Sullins | 43/19 |
| 5,582,392 | 12/1996 | Bajric et al. | 254/134.3 R |
| 5,657,984 | 8/1997 | Leo | 124/20.1 |

*Primary Examiner*—John A. Ricci
*Attorney, Agent, or Firm*—Alston & Bird

[57] ABSTRACT

An apparatus (10) for propelling a projectile generally vertically upward includes a Y-shaped member (12) having a shaft (14) and a pair of elongated arms (16) attached to an upper end of the shaft and extending upward therefrom in spaced-apart relation. The shaft slides telescopingly into a hollow tubular ferrule (20) attached to the top end of an elongated pole (18) and is secured within the ferrule by a spring-biased pin (30), the shaft forming an extension of the pole. The arms have upper curved portions (42) each of which curves through an angle substantially greater than 90 degrees, so that the free ends (44) of the arms define a direction that has a substantial component parallel to the pole toward the bottom end (48) thereof. A sling assembly (34) is attached via elastic tubing (38) to the arms, free ends of the tubing being sleeved over the curved portions of the arms.

10 Claims, 3 Drawing Sheets

APPARATUS FOR PROPELLING A PROJECTILE

FIELD OF THE INVENTION

This invention relates to an apparatus for propelling a projectile and, more particularly, to an apparatus for propelling a projectile to a substantial height via human-supplied power.

BACKGROUND OF THE INVENTION

In a variety of pursuits, there is frequently a need to secure a line or rope between one point and another remote or elevated point. For example, in the rescue field, so-called "high angle" rescue often necessitates placing a rope or line up to a point high off the ground, such as a building, a tower, a chair lift on a ski slope, or other structure. A rope is generally put in place by first throwing or propelling a weighted object, to which a light line is attached, over a weight-supporting part of the structure so that the object falls back to the ground with the light line still attached. The light line is then attached to the stronger rope and the rope is pulled up and over the structure, whereupon the rope is secured in a desired manner.

The method of throwing the weighted object to the desired point has obvious drawbacks and limitations, the principal ones being that most persons cannot throw an object to a very significant height above the ground, and most persons cannot always throw an object upward with the degree of accuracy required to place the object where it is needed.

Accordingly, slingshot-type devices have been developed for propelling an object over a greater distance and with greater accuracy than possible by throwing. Most of these, however, are hand-held devices in which a forked member is held in one hand and a sling carrying the object to be propelled is pulled back against the force of elastic bands or the like and then released. One disadvantage of such devices is that the biomechanics of pulling the sling back are poor, i.e., an average person cannot exert a great amount of force by pulling with one arm in the direction required by such devices. Thus, even though the elastic bands might be strong enough to potentially propel the object to a substantial height, the average person cannot utilize the full potential of the device because he or she cannot pull the sling back far enough. Another disadvantage of such devices is that they are awkward to use when propelling an object vertically upward, and therefore are not particularly accurate for such purpose.

SUMMARY OF THE INVENTION

The invention overcomes the above-noted drawbacks associated with prior devices by providing an apparatus for propelling a projectile via human-supplied power to a significant height above the ground or other support surface, in which the apparatus is supported by the support surface rather than the user's hand and arm, so that a significantly greater force can be exerted on the projectile.

To this end, the apparatus includes a generally Y-shaped member having a shaft that extends generally away from the support surface during use, and a pair of elongated arms attached to an upper end of the shaft and extending thereabove. Each of the arms has an upper portion that is curved through an angle substantially greater than 90 degrees, such that a free end of the arm defines a direction having a substantial component parallel to the shaft toward a lower end thereof.

The apparatus further includes a sling assembly including a sling which is attached to the arms via elastic tubing, free ends of the tubing being sleeved over the upper curved portions of the arms. The tubing fits closely about the arms so that friction prevents the tubing from being pulled off the arms.

The apparatus also includes an elongated pole to which the Y-shaped member is attached, with the shaft portion of the Y-shaped member forming an extension of the pole at the top end thereof. Thus, a projectile is propelled to a significant height above the support surface by placing the bottom end of the pole on the support surface with the pole extending upwardly therefrom, placing the projectile in the sling and pulling the sling and projectile generally away from the arms toward the bottom end of the pole in a direction generally parallel to the pole to stretch the elastic tubing, and releasing the sling to propel the projectile upwardly above the support surface.

The apparatus is preferably constructed so that the Y-shaped member removably attaches to the top end of the pole. Further, the pole is preferably of a generally standard type used in the tree surgery field for attaching various pruning and sawing implements, having a hollow tubular ferrule attached at the top end of the pole. The shaft of the Y-shaped member slides telescopingly into the ferrule and is secured therein by a securement device, which preferably is a spring-biased pin that extends through a hole in a side wall of the ferrule into a corresponding hole in the shaft.

The above-noted and other objects and advantages of the invention will become more apparent from the following description of particular embodiments thereof taken in conjunction with the accompanying drawings. The invention, however, is not limited to the particular embodiments described herein.

DETAILED DESCRIPTION OF THE DRAWINGS

Figure 1:
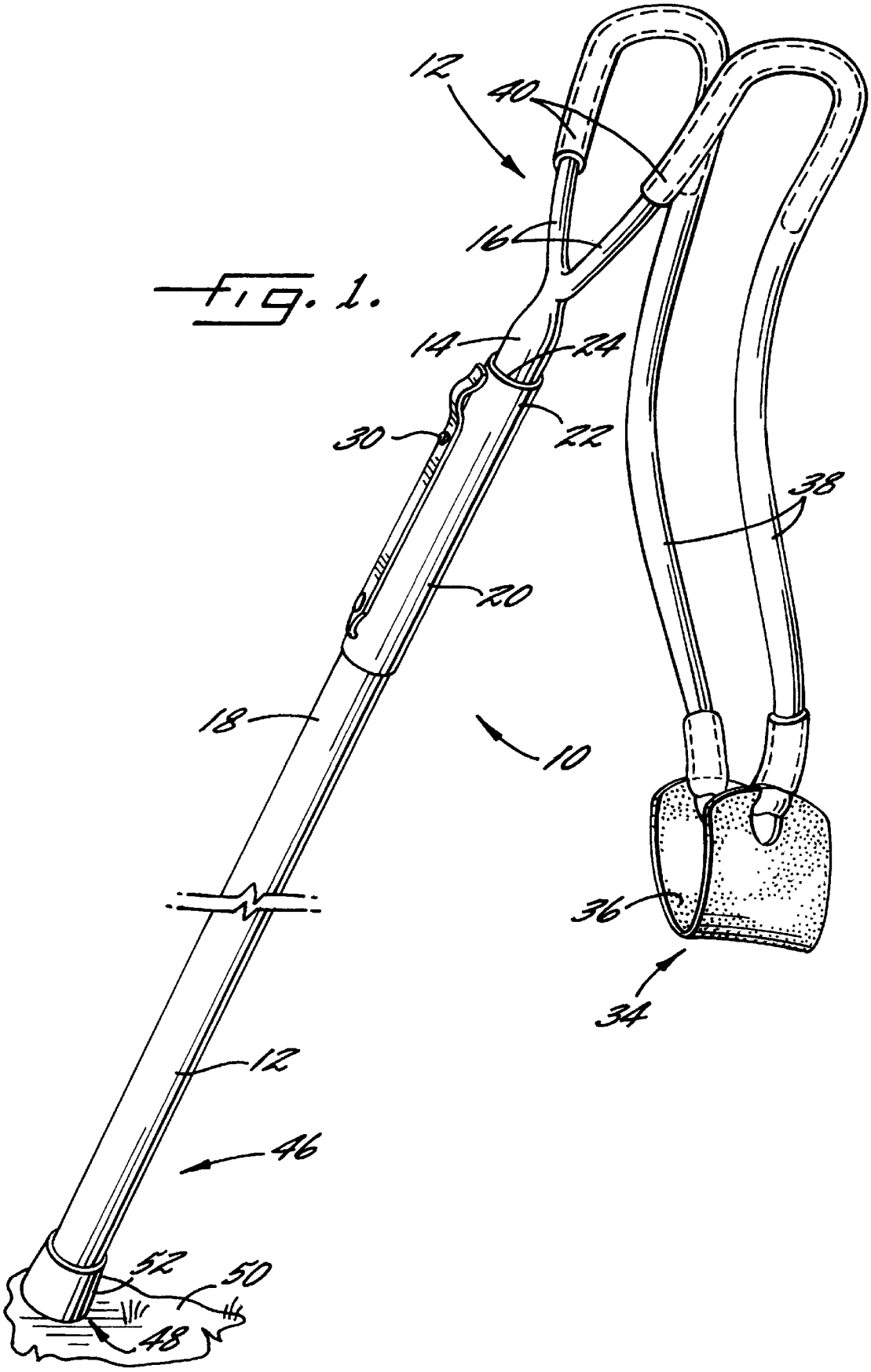
FIG. 1 is a perspective view of an apparatus in accordance with the invention.

With reference to FIGS. 1–5, the apparatus 10 includes a generally Y-shaped member 12 having a shaft 14 and a pair of elongated arms 16 attached to one end of the shaft 14. With the shaft 14 vertical, the arms 16 extend generally vertically upward from the upper end of the shaft 14, and diverge from one another or are otherwise spaced apart at their upper ends to define a space therebetween through which a projectile is propelled, as further described below.

The Y-shaped member 12 is attached to the top end of an elongated pole 18 such that the shaft 14 forms an extension of the pole 18. The pole 18 is of a generally standard type used in the tree surgery field, usually constructed of fiberglass or other electrical insulating material. The pole 18 includes a hollow tubular ferrule 20 affixed to the top end 22 of the pole 18 with an open end 24 of the ferrule 20 directed upward. The shaft 14 slides telescopingly into the ferrule 20 through the open end 24 thereof. The ferrule 20 has a hole 26 (FIGS. 4 and 5) through its side wall, and the shaft 14 has a corresponding hole 28 (FIGS. 2–5) which is alignable with the hole 26. A pin 30 attached to the ferrule 20 via a spring bar 32 is biased by the spring bar 32 to extend through the hole 26, such that when the hole 28 becomes aligned with the hole 26, the pin is snapped into engagement with the hole 28 to secure the shaft 14 within the ferrule 20. The Y-shaped member 12 is thus removably attached to the pole 18.

A sling assembly 34 is attached to the arms 16. The sling assembly 34 includes a sling 36 having two lengths of elastic (i.e., longitudinally stretchable and resilient) tubing 38 attached to opposite sides of the sling 36. The free ends 40 of the elastic tubing 38 are sleeved over the arms 16, fitting tightly enough about the arms 16 so that friction between the tubing 38 and the arms 16 prevents the tubing 38 from being pulled off the arms 16 in normal use.

Figure 2:
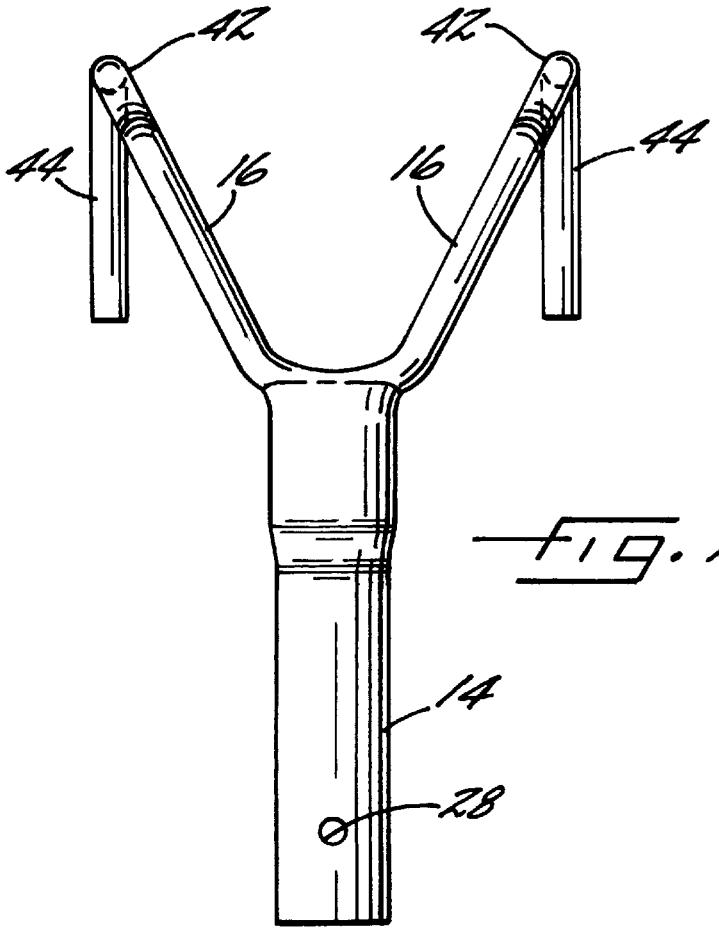
FIG. 2 is a front elevation of the removable forked portion of the apparatus.
Figure 3:
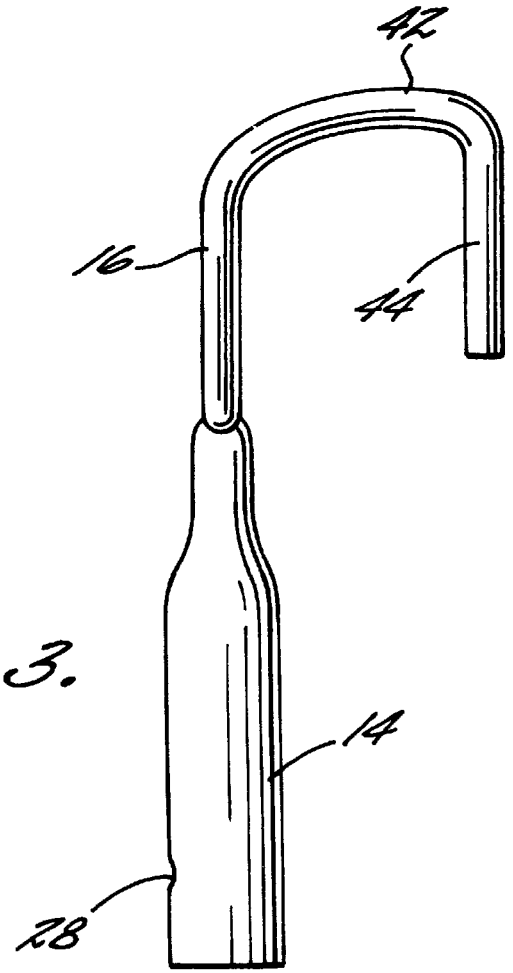
FIG. 3 is a side elevation of the forked portion.
Figure 4:
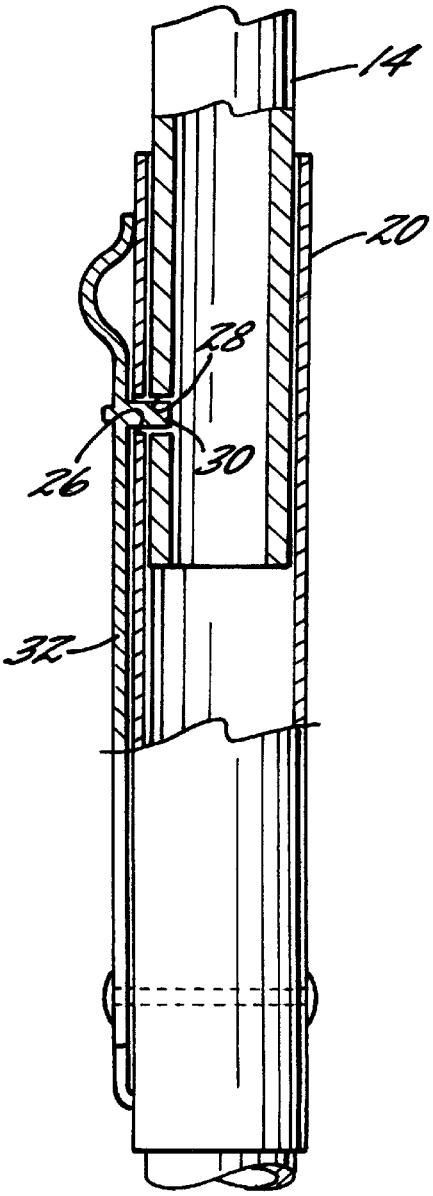
FIG. 4 is a fragmentary side elevation, partly in section, of the apparatus showing the attachment of the pole to the shaft of the forked portion with the spring-biased pin engaging the shaft.
Figure 5:
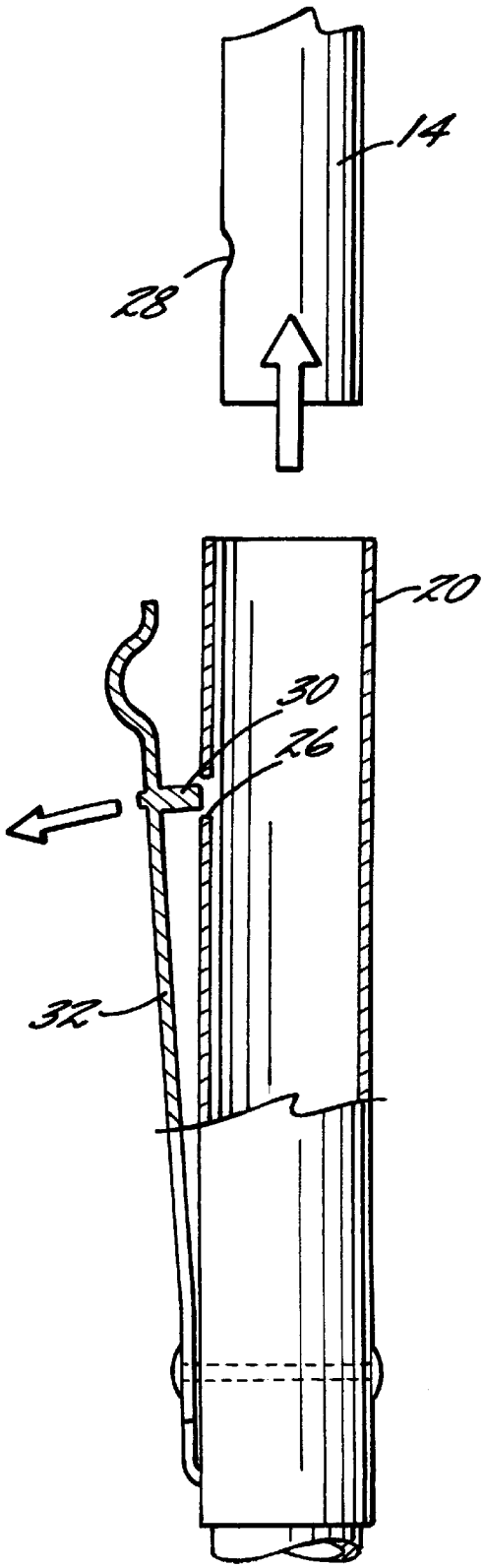
FIG. 5 is a view similar to FIG. 4, showing the spring-biased pin moved into a disengaged position and the forked portion removed from the pole.

The configuration of the arms 16 is an important aspect of the invention. As best seen in FIGS. 2 and 3, each arm 16 has an upper portion 42 that is curved through an angle that is substantially greater than 90 degrees, preferably is at least about 150 degrees, and more preferably is about 180 degrees so that the arm doubles back on itself. Thus, the free end 44 of each arm 16 defines a direction that has a substantial component parallel to the shaft 14 toward the lower end 46 thereof, and consequently has a substantial component parallel with the pole 18 toward the bottom end 48 thereof when the Y-shaped member 12 is installed in the pole 18. The curvature of the arms 16 facilitates a pulling direction for the sling assembly 34 that is generally parallel to and toward the bottom end 48 of the pole 18, as opposed to conventional slingshot devices in which a sling is pulled back generally perpendicular to the direction of the handle held in the other hand. This configuration of the apparatus 10 makes the apparatus ideally suited for propelling projectiles in a generally upward vertical direction. In contrast, conventional slingshot devices are designed to propel objects in a more nearly horizontal direction.

The curvature of the arms 16 also improves the mechanics of the interaction between the arms 16 and the sling assembly 34 so that projectiles are propelled with less resistance from arm-tubing interactions. Furthermore, the curvature of the arms 16 increases the friction between internal surfaces of the tubing and external surfaces of the arms so that the tubing 38 is more firmly held in place on the arms 16.

In use, the apparatus 10 is placed with the lower end 48 resting on the ground 50. A bumper 52 of rubber or other high-friction material is affixed to the bottom end 48 to reduce slippage of the bottom end 48 on the ground 50. A projectile, such as a throw bag, is placed in the sling 36. The throw bag may have a light line, such as monofilament, attached to it. When the apparatus is being used to place the light line over a tree limb, for example, the light line preferably is contained by a reel secured to the ground. The light line preferably is threaded through the space between the arms 16 so that the line is leading the throw bag. One hand of the user grasps the pole 18 to steady it and keep it pointed generally in the direction in which the projectile is to be propelled. The other hand of the user is used to grasp the sling 36 wrapped at least partially about the projectile, and to pull the sling 36 with the projectile therein in a direction generally parallel to the pole 18 toward the bottom end 48, which also defines the opposite direction in which the projectile is to be propelled. The sling 36 is pulled back to stretch the tubing 38 to a desired extent, which may be learned through experience using the apparatus 10, in accordance with the desired height or distance to which the projectile is to be propelled and the weight and air resistance of the projectile. The sling 36 is then released, causing the tubing 38 to return to its original unstretched length and thereby accelerate the sling 36 and projectile opposite to the direction of pull. The projectile comes free of the sling 36 and is thus propelled.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

What is claimed is:

1. An apparatus for propelling a projectile above a generally horizontal support surface, comprising:

a generally Y-shaped member including a shaft having upper and lower ends and a pair of elongated arms attached to the upper end of the shaft and extending upwardly therefrom, the arms having spaced-apart upper portions each of which is curved through an angle substantially greater than 90 degrees such that a free end of each arm defines a direction having a substantial component parallel to the shaft toward the lower end thereof;

a sling assembly including a sling which is attached to the arms via elastic tubing, ends of the tubing being sleeved over the curved portions of the arms; and an elongated pole having a free bottom end and a top end attached to the shaft of the Y-shaped member such that the shaft forms an extension of the pole.

2. The apparatus of claim 1 wherein the arms are curved through an angle of at least about 150 degrees.

3. The apparatus of claim 1 wherein the Y-shaped member is removably attached to the pole.

4. The apparatus of claim 1 wherein the top end of the pole has a receptacle for receiving and engaging the shaft to secure the shaft therein.

5. The apparatus of claim 1, wherein the top end of the pole includes a hollow tubular ferrule and the shaft of the Y-shaped member slides telescopingly into the ferrule, the shaft being secured within the ferrule by a securement device which is disengageable from the shaft to permit removal of the Y-shaped member from the pole.

6. The apparatus of claim 5 wherein the securement device comprises a pin which extends through a hole in a side wall of the ferrule and engages a corresponding hole in the shaft of the Y-shaped member.

7. The apparatus of claim 6, further comprising a spring member which attaches the pin to the ferrule and biases the pin into a position to engage the hole in the shaft.

8. An apparatus for propelling a projectile, comprising:

a generally Y-shaped member which includes a shaft and a pair of arms attached to an upper end thereof, the shaft including a hole extending transversely thereinto;

a sling assembly including a sling which is attached to the arms via elongated longitudinally elastic members; and an elongated pole having a free bottom end and a tubular ferrule affixed to a top end of the pole, the ferrule defining a receptacle into which the shaft of the Y-shaped member is telescopingly received such that a longitudinal axis of the shaft is generally colinear with a longitudinal axis of the pole, the pole further including a spring bar affixed at one end to the ferrule and having a pin attached to the spring bar adjacent the opposite end thereof, the ferrule including a hole alignable with the hole in the shaft, and the spring bar being prestressed to bias the pin into engagement with the aligned holes in the ferrule and shaft such that the shaft is secured within the receptacle by the pin.

9. The apparatus of claim 8, further comprising a friction bumper secured to the bottom end of the pole to reduce slippage of the pole on the support surface during use.

10. The apparatus of claim 8 wherein the pole is made of an electrical insulating material.

* * * * *